US006189218B1

(12) United States Patent
Okada

(10) Patent No.: US 6,189,218 B1
(45) Date of Patent: Feb. 20, 2001

(54) GRIP-TYPE LOCKABLE CUTTER KNIFE

(75) Inventor: Shoji Okada, Sakai (JP)

(73) Assignee: Olfa Corporation, Osaka (JP)

( * ) Notice: Under 35 U.S.C. 154(b), the term of this patent shall be extended for 0 days.

(21) Appl. No.: 09/330,189

(22) Filed: Jun. 11, 1999

(30) Foreign Application Priority Data

Jun. 12, 1998 (JP) ..... 10-165034

(51) Int. Cl.[7] ..... B26B 1/08
(52) U.S. Cl. ..... 30/162; 30/2; 30/319
(58) Field of Search ..... 30/162, 160, 161, 30/159, 2, 335, 307, 319

(56) References Cited

U.S. PATENT DOCUMENTS 4,541,175 9/1985 Boyd et al. .
5,101,564 4/1992 Melter .
5,299,355 * 4/1994 Boda et al. ..... 30/162
5,355,588 10/1994 Brandenburg .
5,924,203 * 7/1999 Huang ..... 30/162 X

* cited by examiner

*Primary Examiner*—Douglas D. Watts
(74) *Attorney, Agent, or Firm*—Evenson, McKeown, Edwards & Lenahan, P.L.L.C.

(57) ABSTRACT

A gripping type of cutter knife wherein a knife blade can be locked into both the retracted and projected positions. This cutter knife includes a locking mechanism of which construction and handling are simple. In this cutter knife, a knife blade is projected by grasping, against spring force, a trigger lever projected from the grip portion of the cutter body. This cutter knife is characterized in that it has a push-type locking mechanism which is selectively held in "unlocking position" wherein the trigger lever is allowed to swing, or "locking position" wherein the swing is prohibited.

2 Claims, 12 Drawing Sheets

GRIP-TYPE LOCKABLE CUTTER KNIFE

BACKGROUND OF THE INVENTION

FIELD OF THE INVENTION

The present invention relates to a grip-type cutter knife wherein a knife blade is projected from a cutter body thereof by pressing a trigger lever.

FIGS. 1 and 2 show one example of a well-known conventional grip-type cutter knife 10. This cutter knife comprises an elongated cutter body 11 provided with a grip portion 12. At the front end of the body 11, there is provided a circular rotary blade 15. In FIG. 1, the rotary blade 15 is projected from the body for cutting. In FIG. 2, the rotary blade 15 is retracted in the body, and the cutting is impossible.

The rotary blade 15 is connected to a swing member which is pivotally supported in the cutter body 11. A part of this swing member is projected from the grip portion 12 to serve as a trigger lever 14 (FIG. 2). The swing member is forced into the non-cutting position (FIG. 2) by a spring member (not shown) arranged in the cutter body 11. That is, when grasping the trigger lever 14 into the cutter body 11 against the spring force, the rotary blade 15 is projected from the forward end of the cutter body 11 (FIG. 1). On the other hand, when releasing the grasping hand, the rotary blade 15 is retracted into a platform 13 at the forward end of the cutter body 11.

Among the grip-type cutters, there are some products which have a cover on the platform 13 of the cutter body 11, or which have a locking mechanism prohibiting the swing of the swing member, in order to avoid the unintentional projection of the blade. The cutter having the locking mechanism is more convenient in handling than that having the cover.

Even among the grip-type cutters having a locking mechanism, although a mechanism locking the knife blade in retracted position is known, a mechanism locking the knife blade in projected position is unknown. It is understood from FIG. 1 that, in order to keep the knife blade projected, a user must keep on grasping the grip portion 12 against the spring force to press the trigger lever in. This would bring physical fatigue to the user in continuous working.

SUMMARY OF THE INVENTION

It is therefore an object of the present invention to provide a grip-type cutter knife wherein a knife blade can be locked in both retracted and projected positions with a locking mechanism the construction and handling of which are both simple.

In view of the above object, the present invention provides a grip type of cutter knife comprising:

- a knife blade which is projected by grasping, against spring force, a trigger lever projected from a grip portion of a cutter body; and
- a push-type locking mechanism which is selectively held in an unlocking position wherein the trigger lever is allowed to swing, or a locking position wherein the swing is prohibited.

Further, the present invention provides a grip type of cutter knife comprising:

- a cutter body having a grip portion;
- a swing member being pivotally supported in the cutter body and carrying a knife blade, wherein one end of the swing member serves as a trigger lever;

- a biasing member forcing the swing member into a non-cutting position wherein the knife blade is retracted in the cutter body and the trigger lever is outwardly projected from the grip portion of the cutter body; and
- a locking member which is longer than a thickness of the cutter body and which is placed through an opening formed in the cutter body and through an elongated opening formed in the swing member, the locking member comprising a larger diameter cylindrical body and a smaller diameter portion partially formed in the cylindrical body;
- wherein the opening formed in the cutter body fits a cross sectional configuration of the locking member so as to allow the locking member to slide only in the thickness direction of the cutter body;
- wherein the elongated opening formed in the swing member comprises a first wider space and a second wider space with a neck portion therebetween, through which neck portion the smaller diameter portion of the locking member is able to pass, but the larger diameter cylindrical body is not able to pass, and
- wherein the locking member has a holding mechanism which holds the locking member itself selectively in an unlocking position wherein the smaller diameter portion of the locking member is in a swing route of the swing member so as to allow the swing member to swing, or a locking position wherein the larger diameter cylindrical body of the locking member is in the swing route of the swing member so as to engage with the first or second wider space to prohibit the swing of the swing member.

In the cutter knife of the present invention constructed as above, the locking member longer than the thickness of the cutter body is held in the cutter body so as to slide only in the thickness direction of the cutter body, so that the locking member can be selectively placed in the "unlocking position" wherein one end of the locking member is projected from one side of the cutter body, or the "locking position" wherein the other end of the locking member is projected from the other side of the cutter body. When the locking member is placed in the "unlocking position" , the smaller diameter portion of the locking member is in the swing route of the swing member. Because the neck portion of the elongated opening formed in the swing member can pass through the smaller diameter portion, the swing member is allowed to swing. On the other hand, when the locking member is placed in the "locking position", the larger diameter cylindrical body of the locking member is in the swing route of the swing member, and engages with the first or second wider space of the elongated opening formed in the swing member. Because the neck portion of the elongated opening formed in the swing member can not pass through the larger diameter cylindrical body, the swing of the swing member is prohibited.

The locking member is to be projected from the different side of the cutter body depending on its positioning in the "unlocking position" or in the "locking position". Further, the locking member is provided with a holding mechanism which selectively holds the locking member itself in the "unlocking position" or the "locking position". Therefore, the switching between the "unlocking position" and the "locking position" can be easily executed by pushing the locking member with a finger.

Further, the knife blade can also be locked in the projected position by switching the locking member from the "unlocking position" to the "locking position" when the knife blade is in the projected position (cutting position), as well as that the knife blade can be locked in the retracted position by switching the locking member from the "unlocking position" to the "locking position" when the knife blade is in the retracted position (non-cutting position). Thanks to this function, in the case of continuous working with the cutter knife for a long time, at least the "gripping force for keeping the rotary blade in the projected position" is not needed, so that the physical fatigue due to the continuous working can be lowered.

In the present invention, the holding mechanism of the locking member can be preferably constituted by a protrusion which is laterally projected from the larger diameter cylindrical body and is able to elastically retract into the larger diameter cylindrical body. This protrusion engages with an edge of the opening formed in the cutter body so as to selectively hold the locking member in the "unlocking position" or the "locking position".

In the case this holding mechanism is employed, because of the appropriate snap fitting at the time of reaching the "unlocking position" or the "locking position" of the locking member, not only the holding of the locking member at each position is ensured, but also a sense of safety at handling is enhanced.

BRIEF DESCRIPTION OF THE DRAWINGS

This and other objects and features of the present invention will become clear from the following description taken in conjunction with the preferred embodiment thereof with reference to the accompanying drawings, in which.

DETAILED DESCRIPTION OF THE PREFERRED EMBODIMENT

Figure 1:
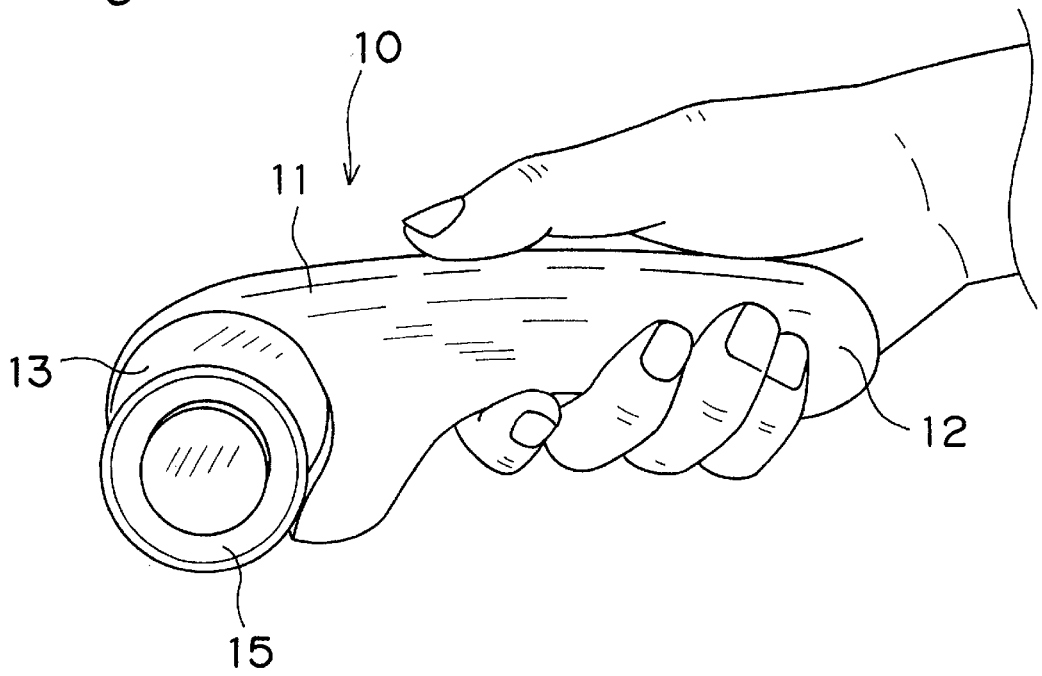
Fig.1 PRIOR ART
FIG. 1 shows a conventional grip-type cutter knife with its rotary blade being projected.
Figure 2:
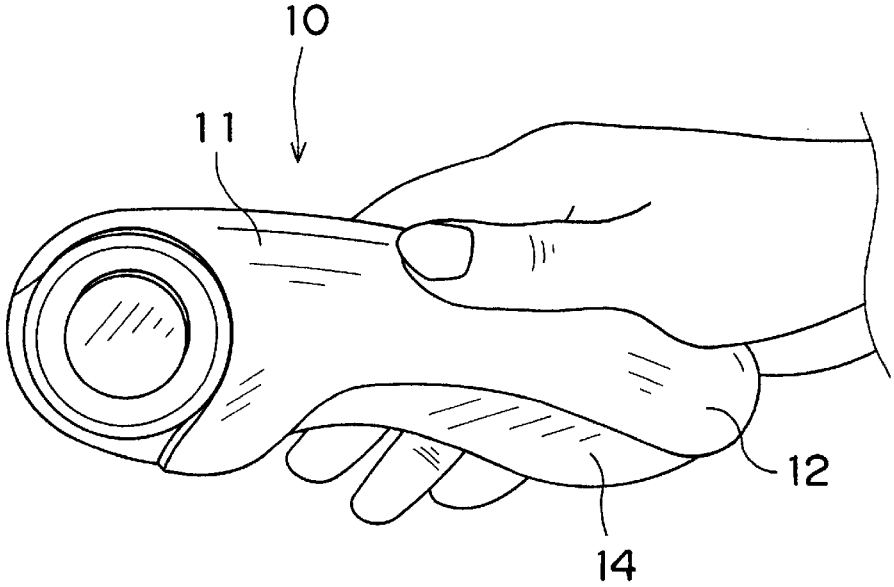
Fig.2 PRIOR ART
FIG. 2 shows the cutter knife of FIG. 1 with its rotary blade being retracted.
Figure 3:
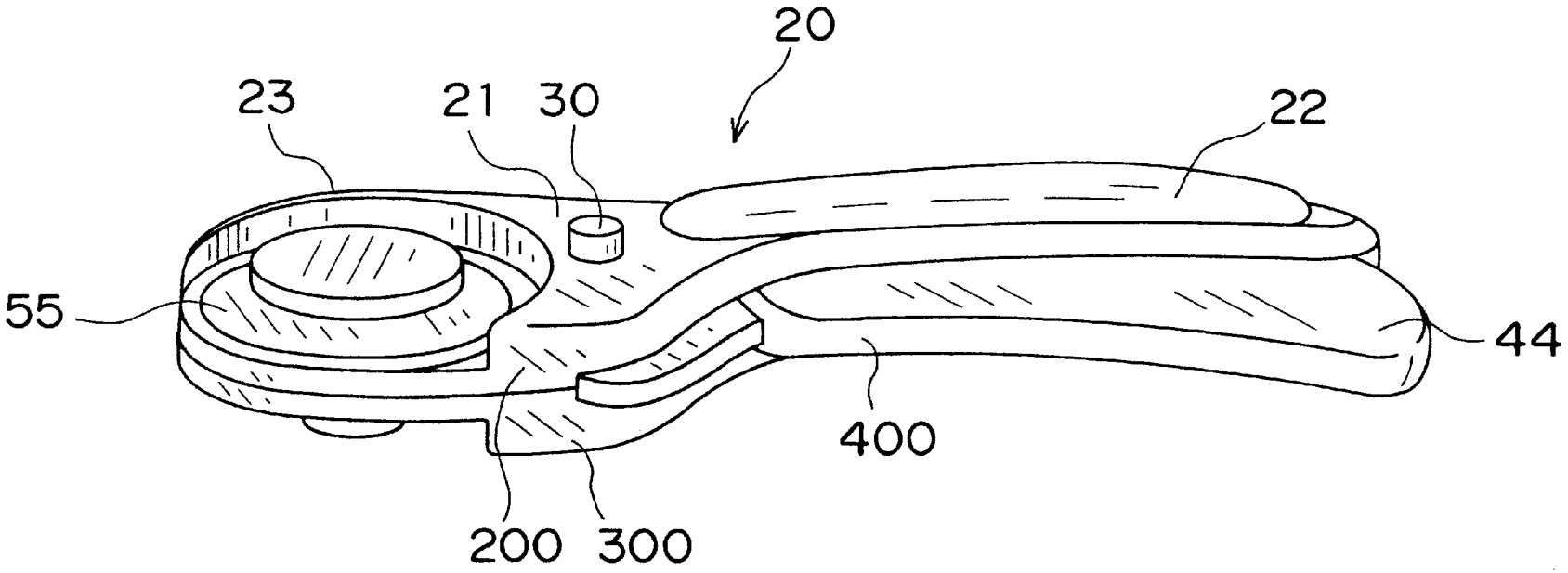
FIG. 3 is a perspective view showing an embodiment of the cutter knife, of the present invention, being in a locked condition.
Figure 4:
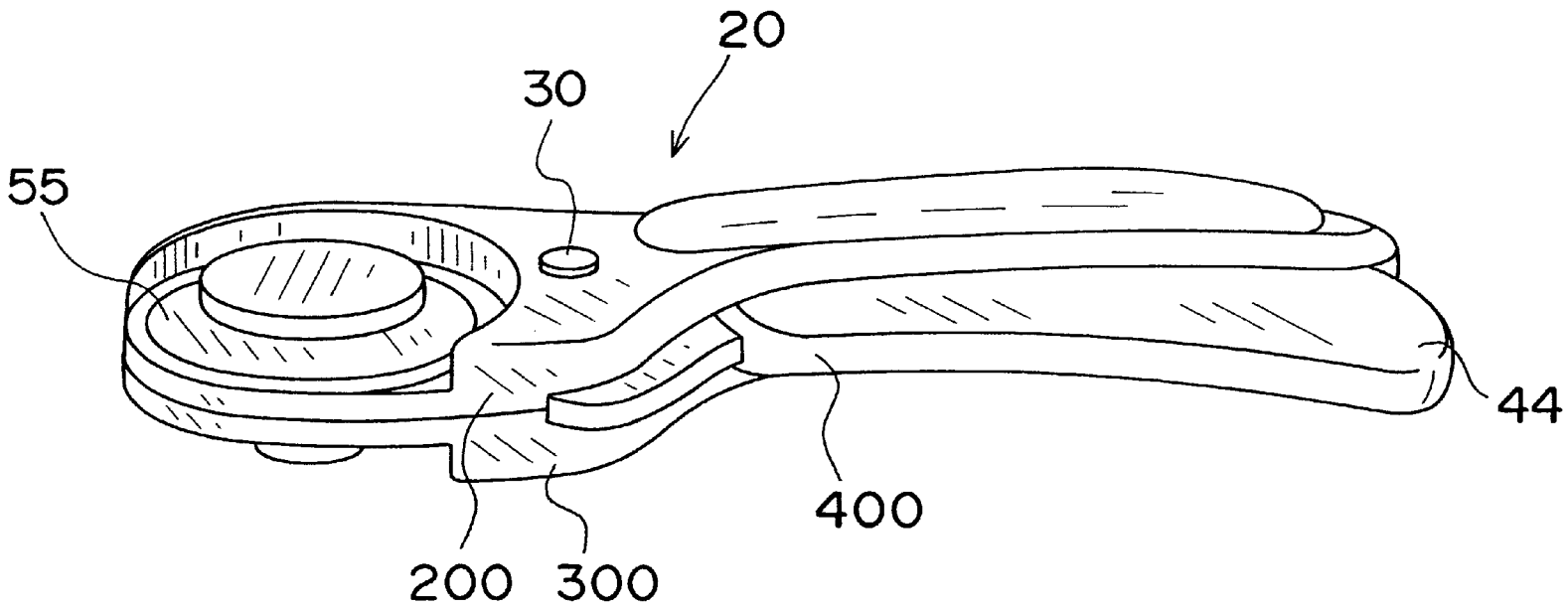
FIG. 4 is a perspective view showing the cutter knife of FIG. 3 being in an unlocked condition.

FIGS. 3 and 4 are perspective views showing an entire cutter knife 20 of the present invention. The cutter knife 20 is distinguished from the conventional one 10 in FIGS. 1 and 2 by the fact that the cutter knife 20 is provided with a push-type lock button 30. As to other basic construction, there is no difference between them.

Figure 10:
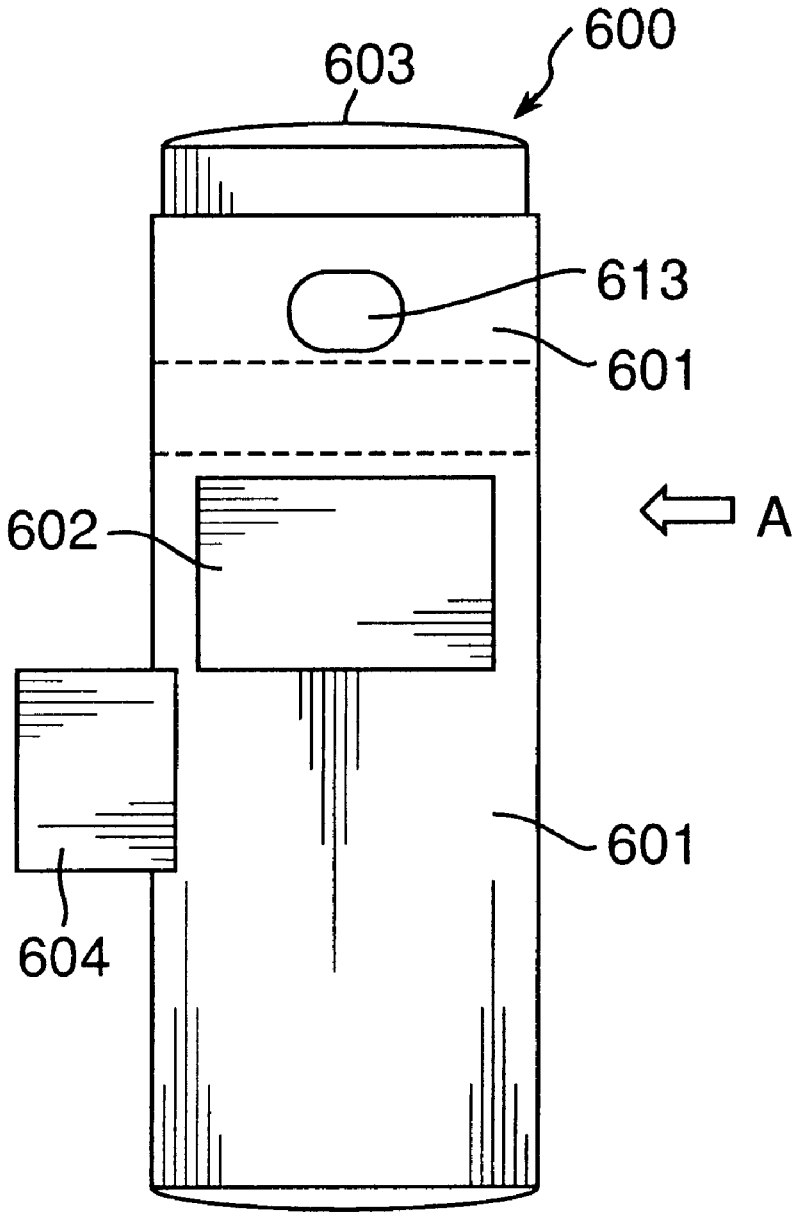
FIG. 10 is a side elevational view showing a locking member employed in the cutter knife of FIG. 3.

The lock button 30 is constituted by a cylindrical locking member 600 (FIGS. 10 and 11), which is described in detail later. The height (or length) of the lock button 30 is equal to the sum of "cutter body thickness" and "upward projection amount in FIG. 3"". That is, when the lock button 30 is pushed into the cutter body 21 from FIG. 3 to FIG. 4, the lock button 30 is downwardly projected from the backside of the cutter body 21 in FIG. 4. The downwardly projected portion does not appear in FIG. 4.

When the lock button 30 is upwardly projected (FIG. 3), the swing of a swing member 400 is prohibited so that a rotary blade 55 cannot move. Hereinafter, this position of the lock button 30 is referred to as "locking position". On the other hand, when the lock button 30 is pushed into the cutter body 21 so as to downwardly project (FIG. 4), the rotary blade 55 can freely move with grasping or releasing a grip portion 22. Hereinafter, this position of the lock button 30 is referred to as "unlocking position". The detail mechanism of the cutter knife 20 is explained below.

As shown in FIGS. 3 and 4, the cutter knife 20 comprises two body pieces 200, 300 and a swing member 400 sandwiched therebetween. The two body pieces 200 and 300 constitute the cutter body 21. The swing member 400 carries the rotary blade 55 and one end of the member 400 serves as a trigger lever 44.

Figure 5:
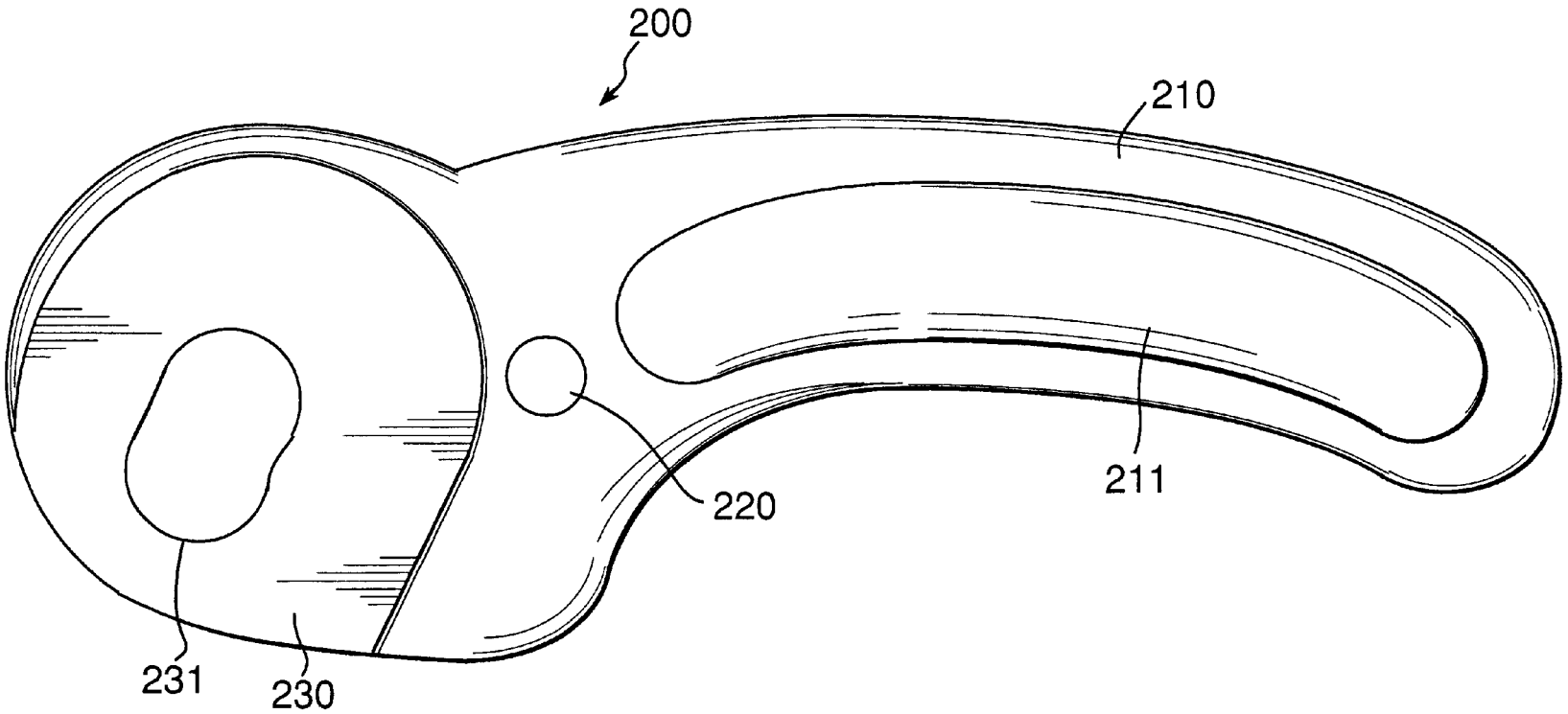
FIG. 5 is a plan view showing an outer surface of one body piece which constitutes the cutter body.
Figure 6:
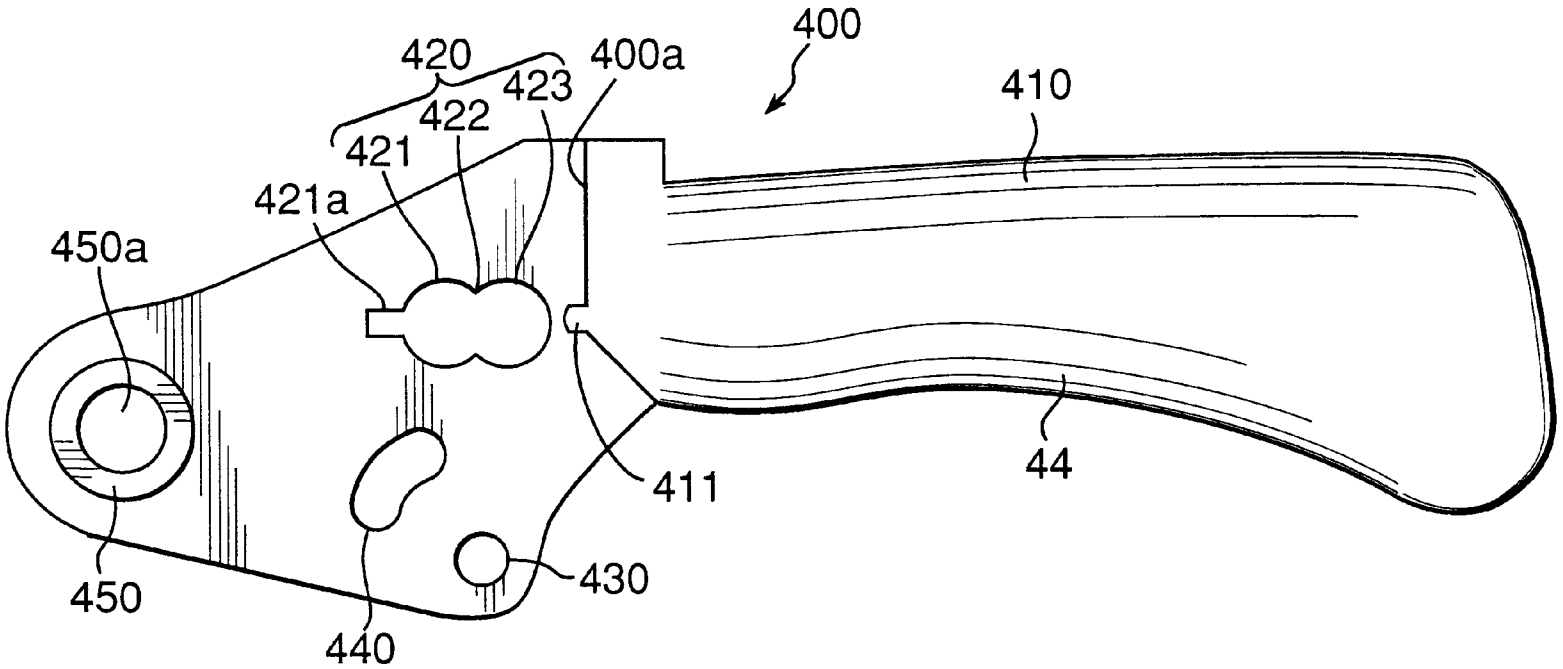
FIG. 6 is a plan view of a swing member which is pivotaly supported in the cutter body.
Figure 7:
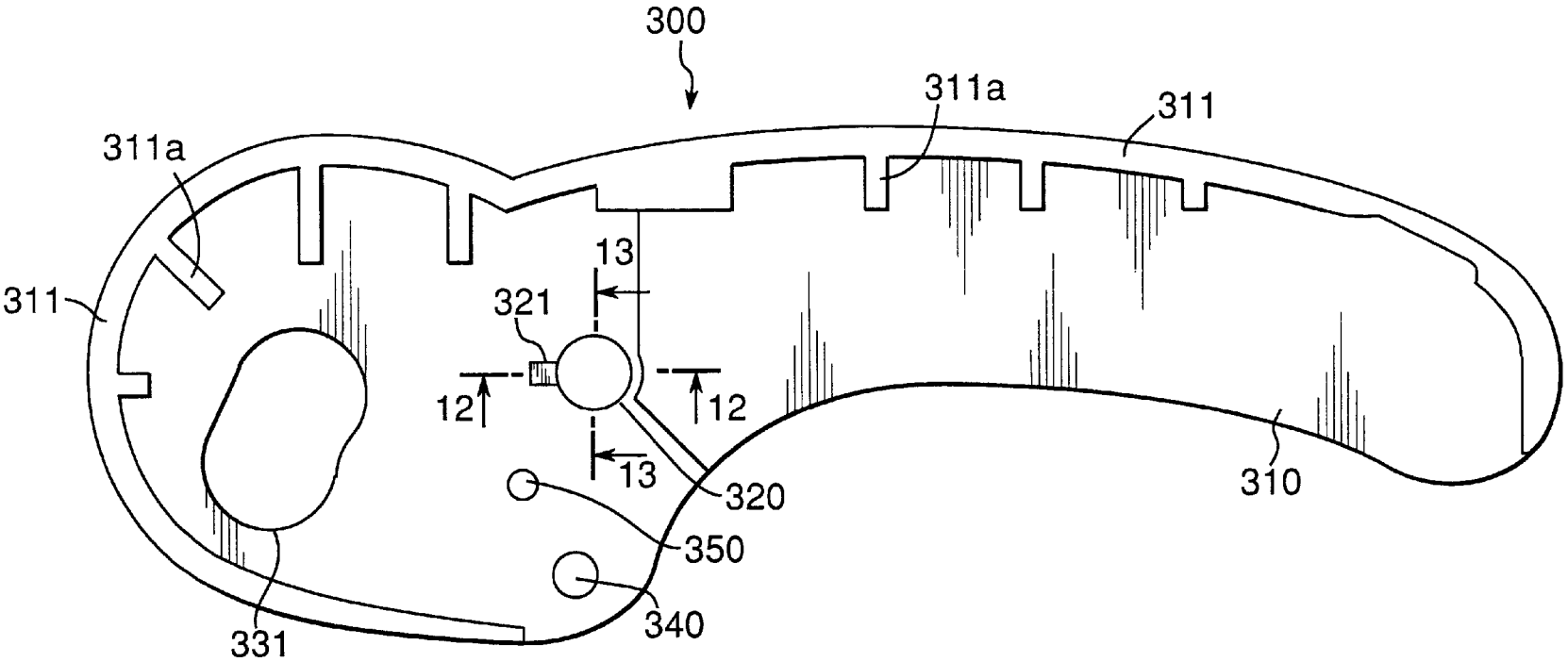
FIG. 7 is a plan view showing an inner surface of the other body piece which constitutes the cutter body.

FIG. 5 shows the outer surface of the body piece 200, and FIG. 7 shows the inner surface of the body piece 300. The swing member 400 shown in FIG. 6 is placed on the inner surface of the body piece 300, and the body piece 200 is placed thereon to integrate these three members. Of course, at this time, a spring 500 described below and the locking member 600 are also mounted between the body pieces.

The body piece 200 of FIG. 5 has a configuration corresponding to that of cutter body 21 shown in FIGS. 3 and 4. The body piece 200 is, at its front end, provided with a platform 230 which accommodates the rotary blade 55. At the center of the platform 230, elongated circular opening 231 is formed for allowing the rotary blade 55 to slide. At the opposite side of the platform 230, an elongated grip portion 210 is arranged. On the outer middle surface of the grip portion 210, there is formed a bulging land 211 intended for an ornament and improving the grip feeling. Between the platform 230 and grip portion 210, a circular opening 220 is formed for holding the cylindrical locking member 600 described below (FIGS. 10 and 11) in the thickness direction of the cutter body 21.

The body piece 300 is shown in FIG. 7 at its inner surface, and the contour of the piece 300 is the same as that of the body piece 200 shown in FIG. 5. At the peripheral portion of the inner surface of the body piece 300, other than the area where the swing member passes through, rib wall 311 is formed for connection and reinforcement. Plural inwardly protruding walls 311*a* are extended from the rib wall 311 at predetermined interval to each other. Also on the body piece 300, there is formed a circular opening 320 and an elongated circular opening 331, respectively, corresponding to the circular opening 220 and the elongated circular opening 231 of the body piece 200 shown in FIG. 5. But, note that, to the circular opening 320, a key way 321 outwardly extending is adjoined. As described later, this key way 321 is intended to guide the sliding of the locking member 600.

In FIG. 7, at the slightly lower position from the circular opening 320, two bosses 340 and 350 are formed. The boss 340 with a relatively larger diameter is intended for a swing center of the swing member 400 and for supporting a coil portion of the coil spring 500 (FIGS. 8 and 9) described later. The boss 350 with a relatively smaller diameter is intended for abutting a relatively shorter arm 502 of the spring 500.

FIG. 6 shows the swing member 400 placed between the two body pieces 200 and 300. The swing member 400 has a boss 450 at its front end (left side in the drawing) for holding the rotary blade 55. This boss 450 is comprised of a cylindrical wall 450 and a bore 450*a* formed therein. Into this bore 450*a*, a shaft (not shown) for rotation center of rotary blade 55 is inserted. The opposite end of the swing member 400 to the boss 450 is a grip portion 410 which serves as a trigger lever 44 projecting from the cutter body 21.

In FIG. 6, between the boss 450 and grip portion 410, there is formed an elongated opening 420 which is constituted by partially overlapping two circular openings. The function of this elongated opening 420 will be explained later. Below the opening 420, there is formed a circular opening 430 intended for swing center of this swing member 400. Into this opening 430, the supporting boss 340 formed on the inner surface of the body piece 300 is inserted, so that the swing member 400 can swing in the cutter body 21 around the supporting boss 340. An opening 440 formed between the swing opening 430 and the elongated opening 420 provides a run-off space for the abutting boss 350 during the swing of the swing member 400.

The swing member 400 is formed to be thicker at the region of its grip portion 410 (right side in FIG. 6), and to be thinner plate than the grip portion 410 at the region wherein the boss 450, and the openings 420, 430, 440 are formed. As a result, a wall 400 *a* of a predetermined configuration is formed between the thicker region and the thinner region. A part 411 of this wall 400 *a* serves as an abutment for a relatively longer arm 503 of the spring 500.

Hereinafter, with reference to FIGS. 8 and 9, the swing of the swing member 400 is described. For the sake of clear explanation, the upper body piece 200 and the rotary blade 55 are not shown in FIGS. 8 and 9.

Around the supporting boss 340 upwardly projecting from the swing opening 430 of the swing member 400, a coil portion 501 of the spring 500 is placed. The spring 500 is comprised of the one roll coil portion 501, and longer and shorter arms 503, 502 projected therefrom. The shorter arm 502 is forcedly abutting against the boss 350, and the longer arm 503 is forcedly abutting against the abutment 411. The spring 500 forces the swing member 400 relatively to the body piece 300 (in other words, relatively to the cutter body 21) into the position shown in FIG. 8 wherein the trigger lever 44 is projected at maximum. At this potion, the rotary blade 55 (not shown in FIGS. 8 and 9) is retracted into the platform 230 (FIG. 5) of the body piece 200. From the position in FIG. 8, by grasping the grip portion of the cutter body so as to press the trigger lever 44 into the cutter body, the position of FIG. 9 is realized and the rotary blade 55 is projected from the front end of the cutter body. When releasing the gripping hand, the swing member 400 will return to the original position shown in FIG. 8 by virtue of the spring force of the spring 500.

Figure 8:
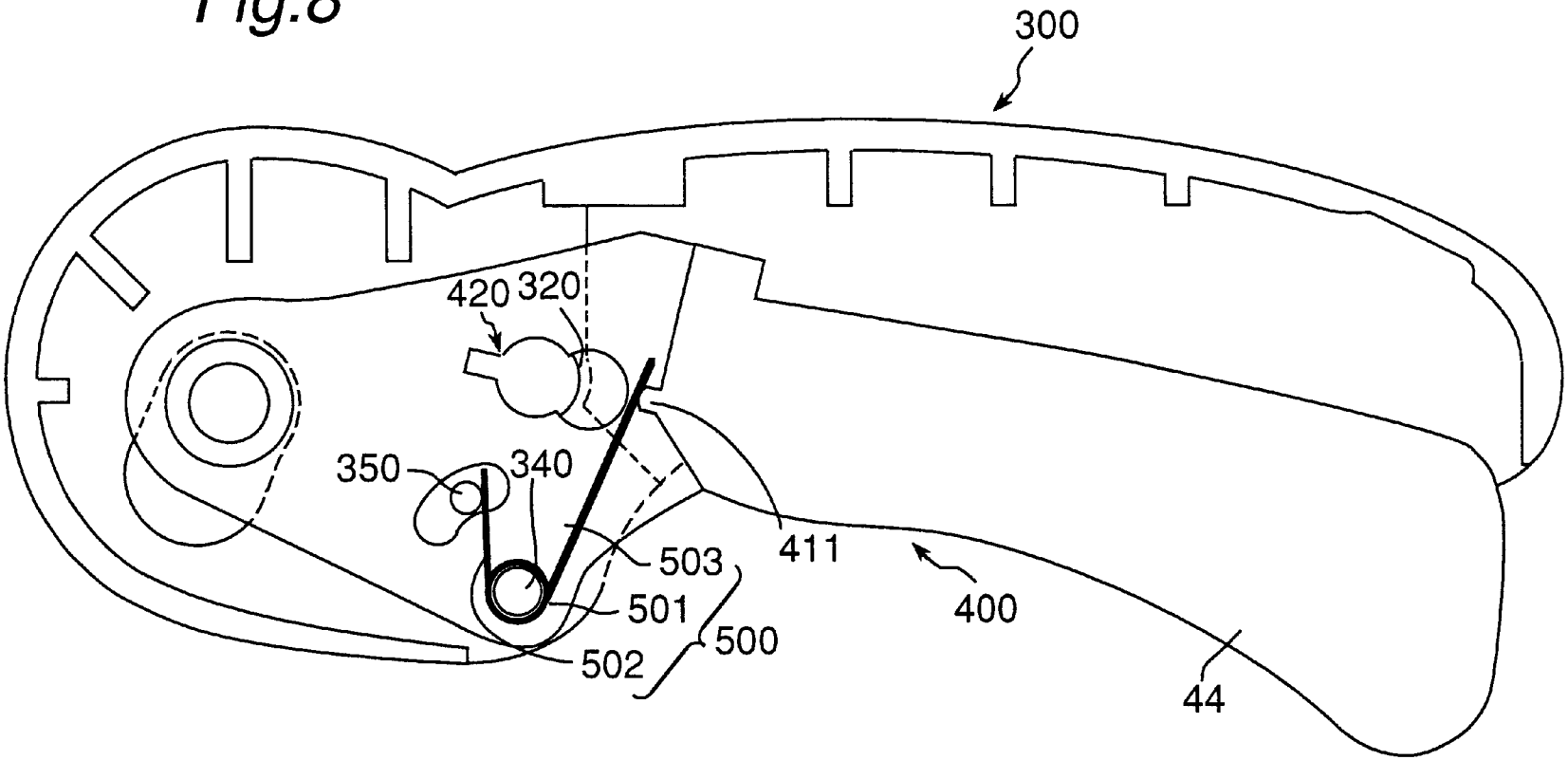
FIGS. 8 and 9 explain the swing of the swing member of FIG. 6.
Figure 9:
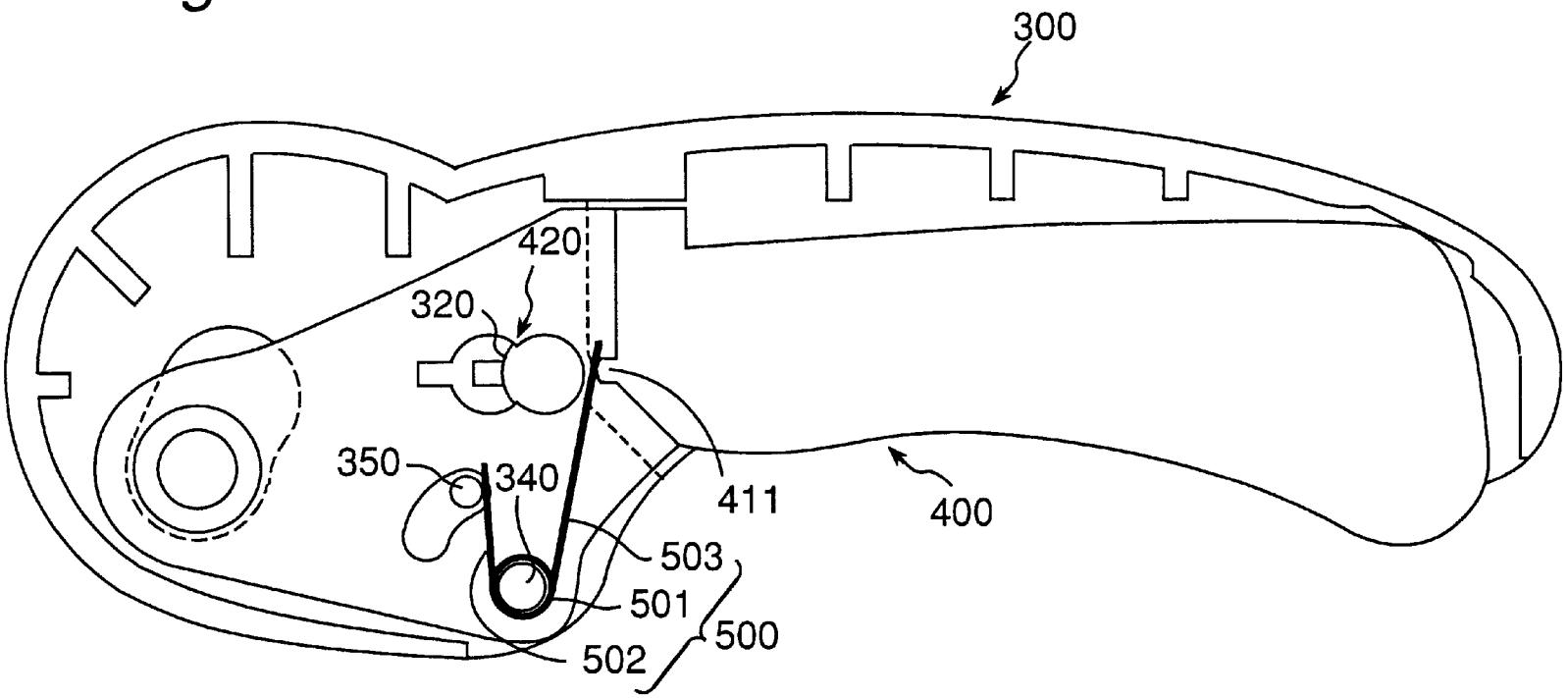
Figure 11:
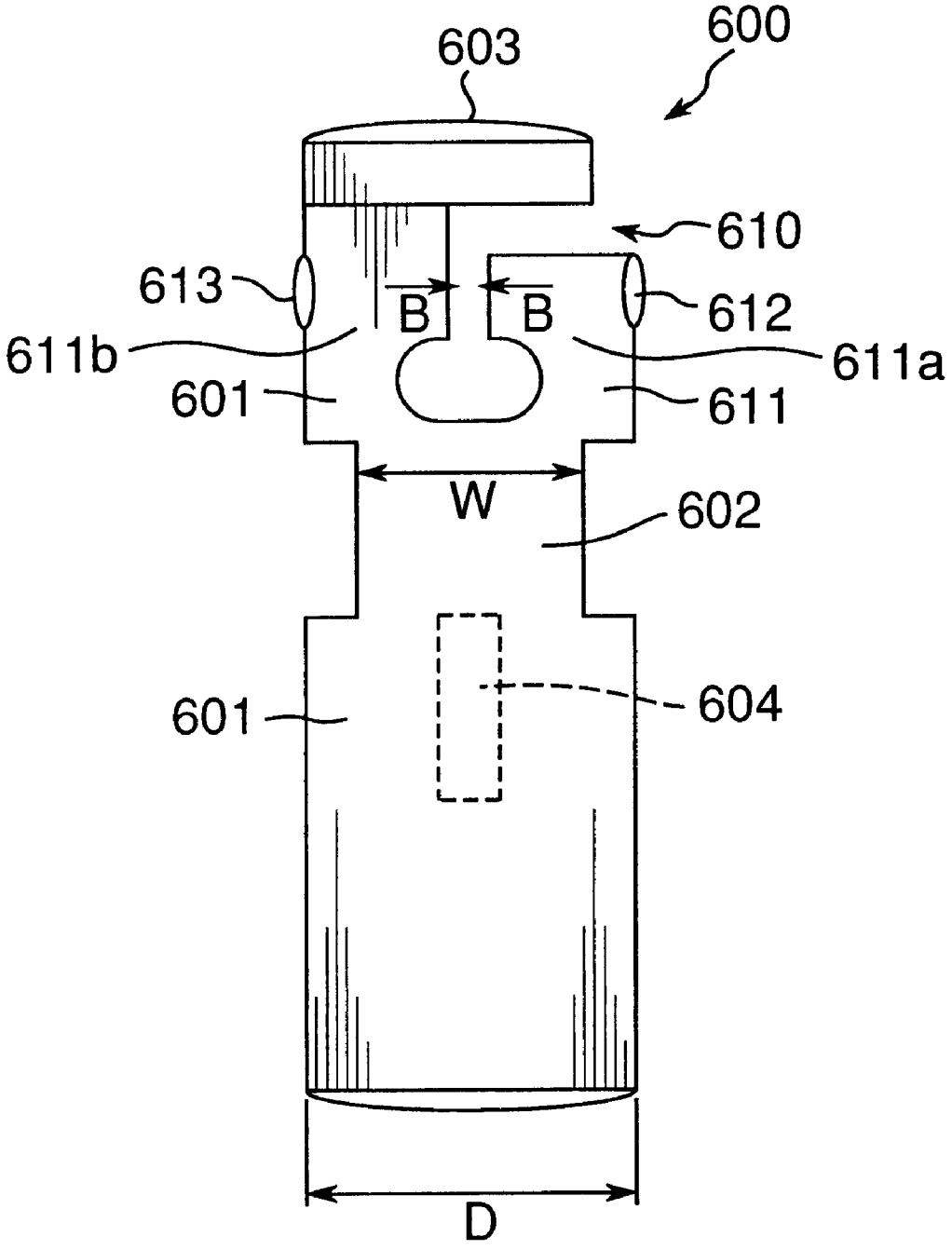
FIG. 11 is a side elevational view of the locking member of FIG. 10, shown from the direction A.

The above explanation with FIGS. 8 and 9 is made with granting that there is no locking mechanism and therefore the swing member 400 can freely swing. But actually in the present invention, there is employed a locking mechanism which selectively allows the swing member 400 to freely swing, or locks the same into positions wherein the rotary blade 55 is retracted into or projected from the cutter body 21. This locking mechanism is comprised of the circular openings 220, 320 formed in the body pieces 200, 300, the elongated opening 420 formed in the swing member 400, and the cylindrical locking member 600 shown in FIGS. 10 and 11. FIG. 11 shows the side view of the locking member 600 seen from the direction represented by an arrow A.

The locking member 600 comprises a generally cylindrical and larger diameter body 601, and a smaller diameter portion 602 at approximately middle of body height. The smaller diameter portion 602 is formed by partially removing the circumference wall of the larger diameter body 601. At the outer surface of the larger diameter body 601, there is integrally formed a fin-like key 604 which is outwardly projecting. This key 604 slides through the key way 321 formed in the lower body piece 300 so as to guide the locking member 600 to slide without changing its orientation.

Near the upper end of the locking member 600, an inlet 610 is formed. As shown in FIG. 11, the inlet 610 is formed like an L-character, and the cross section at its bottom is made to be elongate circular. Two elastically deformable portions 611*a* and 611*b* are defined by this inlet 610. That is, because the whole of the locking member 600 is made of plastic material, under external pressing force, two deformable portions 611*a* and 611*b* defined by the inlet 610 can deform so as to approach to each other in the direction represented by arrows B. In other words, the two deformable portions 611*a* and 611*b* can be elastically retracted into the larger diameter body 601 in the direction represented by arrows B. When the pressing force is released, both of the deformable portions elastically return to the original position. The head 603 is intended for concealing the inlet 610. On the outer surface of one deformable portion 611*a*, there is integrally formed a protrusion 612. On the surface of the other deformable portion 611*b*, there is also integrally formed a same protrusion 613. The function of these protrusions 612, 613 will be explained in detail later.

Figure 12:
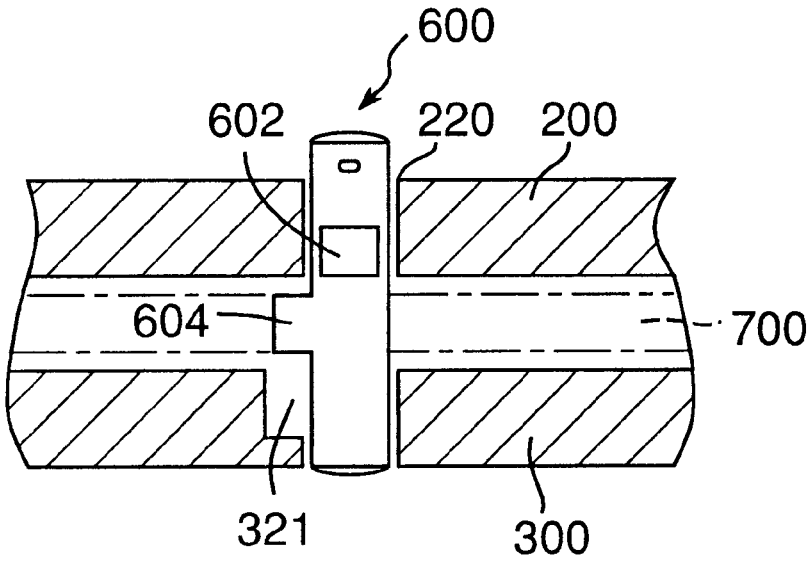
FIGS. 12 to 15 explain the locking mechanism in the cutter knife of FIG. 3.
Figure 13:
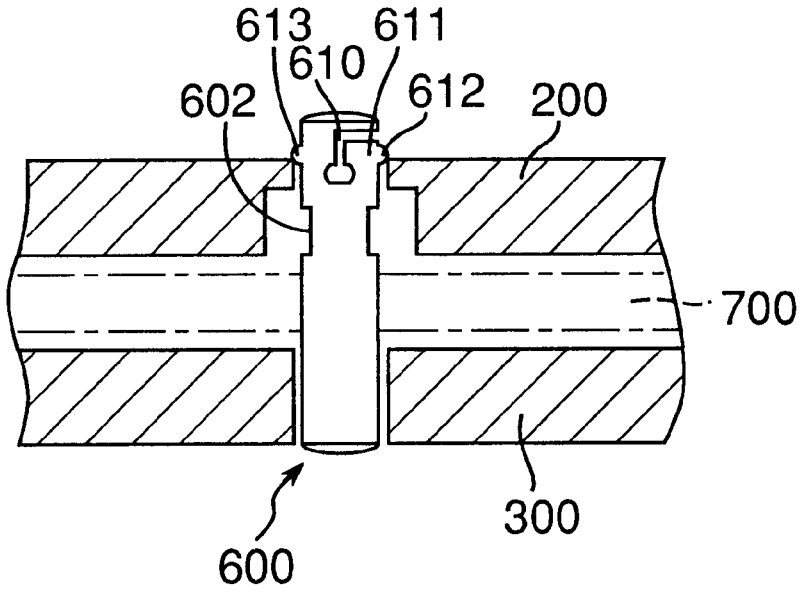
Figure 14:
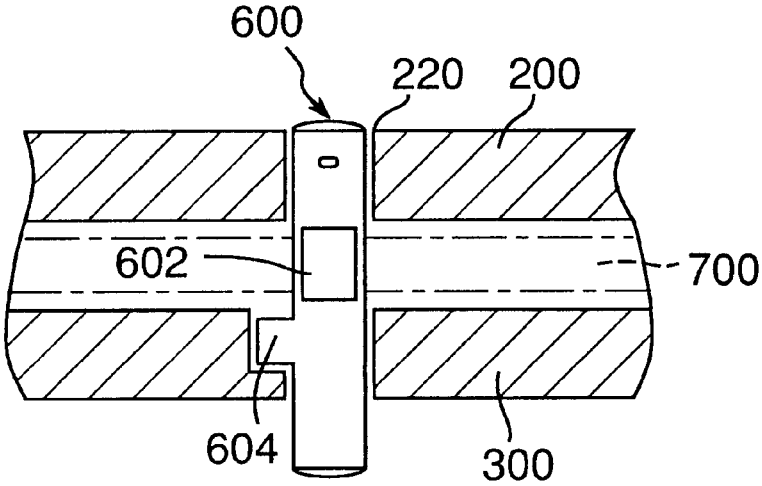
Figure 15:
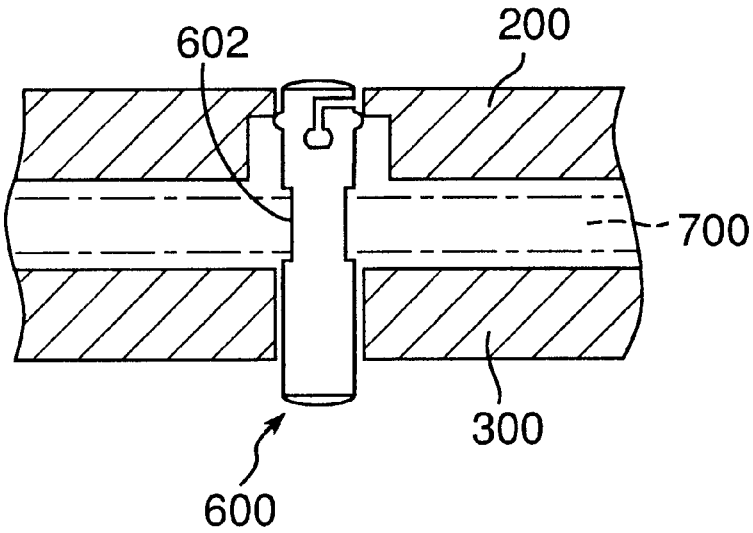

The locking member 600 is assembled into the cutter body 21 by placing it through the circular openings 220, 320 formed in the body pieces and the elongated opening 420 formed in the swing member 400. FIGS. 12 to 15 show cross sections of main portion explaining the function of the locking member 600. FIGS. 12 and 14 are respectively a cross section along the line 12—12 in FIG. 7. Note that although in FIG. 7 one body piece 300 is shown solo, in FIGS. 12 and 14 the other body piece 200 and the locking member 600 are also shown in addition. FIGS. 13 and 15 are respectively a cross section along the line 13—13 in FIG. 7. In these Figs., like the case of FIGS. 12 and 14, the other body piece 200 and the locking member 600 are also shown in addition. In FIGS. 12 to 15, an orbit zone 700 represented by the imaginary lines is a swing route of the swing member 400.

In FIGS. 12 and 13, the locking member 600 is in the "locking position" wherein the locking member 600 is upwardly projected from the upper body piece 200. It can be understood that, in this "locking position", the smaller diameter portion 602 is out of the swing route 700 of the swing member 400, and the larger diameter body 601 is in the swing route 700. Pressing down the locking member 600 from the "locking position" brings the locking member 600 into the "unlocking position" shown in FIGS. 14 and 15, so that the locking member 600 is downwardly projected from the lower body piece 300. It can be understood that, in this "unlocking position", the smaller diameter portion 602 of the swing member 400 is in the swing route 700 of the swing member 400.

Now referring to FIG. 6, the elongated opening 420 of the swing member 400 is formed by overlapping two circular openings 421 and 423, and therefore, the elongated opening 420 has a neck portion 422 between the two openings 421 and 423. In other words, the openings 421 and 423 provide wider spaces on both sides of the neck portion 422. The width of the neck portion 422 is set to be larger than the width W (FIG. 11) of the smaller diameter portion 602 of the locking member 600, but to be smaller than the diameter D (FIG. 11) of the larger diameter body 601. As to the diameters of both of the openings (wider spaces) 421 and 423, they are set to fit the diameter D of the larger diameter body 601 of the locking member 600. The rectangular opening 421*a* (FIG. 6) adjoined to the opening 421 provides a run-off space for the key 604 during the sliding of the locking member 600.

Because the locking member 600 is inserted into the elongated opening 420 of the swing member 400, when the locking member 600 is in the "unlocking position" (FIGS. 14 and 15) wherein the smaller diameter portion 602 is in the SWing route 700, the neck portion 422 of the elongated opening 420 can pass through the smaller diameter portion 602 so as to allow the swing of the swing member 400. In contrast with this, when the locking member 600 is in the "locking position" (FIGS. 12 and 13) wherein the larger diameter body 601 is in the swing route 700, the neck portion 422 of the elongated opening 420 cannot pass through the larger diameter body 601 so as to prohibit the swing of the swing member 400. When the left side opening 421 in FIG. 6 engages with the larger diameter body 601, the rotary blade 55 is locked in the retracted position. When the right side opening 423 in FIG. 6 engages with the larger diameter body 601, the rotary blade 55 is locked in the projected position.

Although the locking member 600 is cylindrical in the shown embodiment, the cross section of the locking member is not necessarily circular and may be elliptical or polygonal in shape. But, in that case, in compliance with the configuration of the locking member, the configuration of the openings 220, 320 formed in the body pieces and the openings (wider spaces) 421, 423 constituting the elongated opening 420 in the swing member 400 are also made to be elliptical or polygonal to fit the locking member.

Now referring to FIGS. 13 and 15, it can be understood that when the locking member 600 is in the "locking position" (FIG. 13), the protrusions 612 and 613 engage with the upper edge of the opening 220 formed in the body piece 200, and when the locking member 600 is in the "unlocking position" (FIG. 15), the protrusions 612 and 613 are engaged with the inner edge of the opening 220. That is, only when applying some extent of power on the locking member, one can push down the locking member 600 from the "locking position" to the "unlocking position". Because the protrusions 612 and 613 are formed on the abovementioned deformable portions 611*a* and 611*b*, when one presses the locking member 600 with some extent of power, the protrusions 612, 613 are elastically retracted, so that he/she can slide down the locking member 600. When the locking member 600 reaches the "unlocking position" shown in FIG. 15, both of the protrusions 612 and 613 elastically return to the original position with an appropriate snap fitting. Also when moving the locking member 600 from the "unlocking position" to the "locking position", the same effect will be brought.

Because the openings 220, 320 formed in the upper and lower body pieces 200, 300 have each diameter fitting to circular cross sectional configuration of the locking member 600, the locking member 600 is allowed to slide only in the thickness direction of the cutter body 21.

As can be understood from the above explanations, in the grip-type cutter knife of the present invention, when the locking member 600 is kept in the "unlocking position", the swing member 400 can freely swing. Further, the swing member 400 is forced by the spring 500 to the "non-cutting position" like in FIG. 2. Therefore, the user can continue to handle the cutter knife of the present invention with keeping it in a condition that when gripping the grip portion, the rotary blade 55 is projected, and when releasing the gripping hand, the rotary blade 55 is automatically retracted.

To the contrary, in the case that the user does not handle the cutter knife, he/she releases his/her hand from the grip portion to retract the rotary blade 55, and in this condition he/she can lock the rotary blade 55 in the retracted position by pushing the locking member 600 into the "locking position". In the case of continuous working with the cutter knife for a long time, he/she grips the grip portion to project the rotary blade 55, and in this condition he/she can lock the rotary blade 55 in the projected position by pushing the locking member 600 into the "locking position". In the conventional cutter of FIGS. 1 and 2, in the case of continuous working with the cutter knife for a long time, there are needed both "pressing force for cutting objects" and "gripping force for keeping the rotary blade in the projected position". Therefore, there arises a problem that the continuous work is often accompanied by large physical fatigue. To the contrary in the present invention, at least the "gripping force for keeping the rotary blade in the projected position" is not needed, so that the physical fatigue is accordingly lowered.

Further, the switching between the "unlocking position" and the "locking position" can be executed by merely pushing the locking member 600 (lock button 30) with a finger which is projected from the cutter body. Therefore, handling is easier than that of the lever-type or screw-type of locking mechanism, and the switching can be executed with holding the cutter knife in one hand.

In the above, the present invention have been described as a cutter knife carrying a rotary blade as a knife blade. But, the present invention is characterized by its locking mechanism, and therefore the configuration of the knife blade is not to be limited to particular one.

What is claimed is:

1. A grip type of cutter knife comprising:

a cutter body having a grip portion;

a swing member being pivotally supported in the cutter body and carrying a knife blade, wherein one end of the swing member serves as a trigger lever;

a biasing member forcing the swing member into a non-cutting position wherein the knife blade is retracted in the cutter body and the trigger lever is outwardly projected from the grip portion of the cutter body; and a locking member which is longer than a thickness of the cutter body and which is placed through an opening formed in the cutter body and through an elongated opening formed in the swing member, the locking member comprising a larger diameter cylindrical body and a smaller diameter portion partially formed in the cylindrical body;

wherein the opening formed in the cutter body fits a cross sectional configuration of the locking member so as to allow the locking member to slide only in the thickness direction of the cutter body;

wherein the elongated opening formed in the swing member comprises a first wider space and a second wider space with a neck portion therebetween, through which neck portion the smaller diameter portion of the locking member is able to pass, but the larger diameter cylindrical body is not able to pass, and wherein the locking member has a holding mechanism which holds the locking member itself selectively in an unlocking position wherein the smaller diameter portion of the locking member is in a swing route of the swing member so as to allow the swing member to swing, or a locking position wherein the larger diameter cylindrical body of the locking member is in the swing route of the swing member so as to engage with the first or second wider space to prohibit the swing of the swing member.

2. The grip type of cutter knife of claim 1, wherein the locking member is provided with a protrusion which is laterally projected from the larger diameter cylindrical body and is able to elastically retract into the larger diameter cylindrical body, and wherein the protrusion engages with an edge of the opening formed in the cutter body to serve as the holding mechanism.

* * * * *